US012344954B2

(12) United States Patent
Wakuda et al.

(10) Patent No.: US 12,344,954 B2
(45) Date of Patent: Jul. 1, 2025

(54) PLATING APPARATUS

(71) Applicant: EBARA CORPORATION, Tokyo (JP)

(72) Inventors: Yohei Wakuda, Tokyo (JP); Yasuyuki Masuda, Tokyo (JP); Masashi Shimoyama, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 0 days.

(21) Appl. No.: 17/923,563

(22) PCT Filed: Feb. 7, 2022

(86) PCT No.: PCT/JP2022/004589
§ 371 (c)(1),
(2) Date: Nov. 4, 2022

(87) PCT Pub. No.: WO2023/148950
PCT Pub. Date: Aug. 10, 2023

(65) Prior Publication Data
US 2024/0301582 A1 Sep. 12, 2024

(51) Int. Cl.
*C25D 17/00* (2006.01)
*C25D 17/06* (2006.01)
*C25D 21/10* (2006.01)

(52) U.S. Cl.
CPC ..... *C25D 17/008* (2013.01); *C25D 17/06* (2013.01); *C25D 21/10* (2013.01)

(58) Field of Classification Search
None
See application file for complete search history.

(56) References Cited

U.S. PATENT DOCUMENTS

2002/0130034 A1 9/2002 Uzoh et al.
2004/0245094 A1* 12/2004 McHugh ..... C25D 17/02 204/253
2012/0261254 A1 10/2012 Reid et al.
2014/0326608 A1* 11/2014 He ..... C25D 17/001 204/242
2017/0342583 A1 11/2017 Thorkelsson et al.

FOREIGN PATENT DOCUMENTS

JP 2003-524079 A 8/2003
JP 6901646 B1 7/2021
WO WO 2022/118431 A1 6/2022

* cited by examiner

*Primary Examiner* — Louis J Rufo
(74) *Attorney, Agent, or Firm* — BakerHostetler

(57) ABSTRACT

In a plating apparatus including a shielding member, an ionically resistive element is disposed to be close to a surface to be plated of a substrate to improve uniformity of a distribution of plating film-thickness.

A plating apparatus includes: a plating tank 410 configured to house a plating solution; a substrate holder 440 configured to hold a substrate Wf with a surface to be plated Wf-a facing downward; an anode 430 disposed in the plating tank 410; an ionically resistive element 450 disposed between the substrate Wf and the anode 430 and including an opposed surface **450-*a* opposed to the surface to be plated Wf-a, the opposed surface 450-*a* including a first opposed surface 450-*a*1 and a second opposed surface 450-*a*2 apart from the surface to be plated Wf-a more than the first opposed surface 450-*a*1; and a shielding member 481 disposed in a depressed region β of the ionically resistive element 450, the depressed region β being formed by the second opposed surface 450-*a*2. The shielding member 481** is for shielding an electric field.

9 Claims, 6 Drawing Sheets

1000

PLATING APPARATUS

TECHNICAL FIELD

This application relates to a plating apparatus.

BACKGROUND ART

As an example of a plating apparatus, there has been known a cup type electroplating apparatus. The cup type electroplating apparatus immerses a substrate (for example, semiconductor wafer) held by a substrate holder with a surface to be plated facing downward in a plating solution, and applies a voltage between the substrate and an anode, thereby depositing a conductive film on a surface to be plated of the substrate.

For example, as disclosed in PTL 1, it has been known that, in a cup type electroplating apparatus, an ionically resistive element is disposed between a substrate and an anode, and a shielding member for shielding an electric field is disposed between the substrate and the ionically resistive element.

CITATION LIST

Patent Literature

PTL 1: Japanese Patent No. 6901646

SUMMARY OF INVENTION

Technical Problem

For the plating apparatus of the prior art, in a plating apparatus including a shielding member, there is a room for improvement in enhancing uniformity of a distributions of plating film-thickness by disposing an ionically resistive element close to a surface to be plated of a substrate.

That is, when the ionically resistive element is disposed between the substrate and an anode, a resistance value between the substrate and the anode increases to make an electric field be less likely to expand. Meanwhile, when the ionically resistive element is disposed to be apart from the surface to be plated of the substrate, a space in which the electric field is expandable increases. Here, since a power feeding contact point of a substrate holder is in contact with an outer edge portion of the substrate, the electric field relatively concentrates to the outer edge portion of the substrate, thus possibly increasing a plating film-thickness of the outer edge portion.

In view of this, it is desired to make a film-thickness distribution of a plating film formed on a surface to be plated of a substrate uniform by disposing an ionically resistive element close to the surface to be plated. However, when a shielding member is disposed between the ionically resistive element and the substrate, the ionically resistive element needs to be disposed to be apart from the surface to be plated of the substrate to avoid an interference between the ionically resistive element and the shielding member, and consequently, the uniformity of the distribution of plating film-thickness is possibly diminished.

Therefore, it is an object of this application to enhance a uniformity of a distribution of plating film-thickness by disposing an ionically resistive element close to a surface to be plated of a substrate in a plating apparatus including a shielding member.

Solution to Problem

According to one embodiment, a plating apparatus is disclosed. The plating apparatus includes: a plating tank configured to house a plating solution; a substrate holder configured to hold a substrate with a surface to be plated facing downward; an anode disposed in the plating tank; an ionically resistive element disposed between the substrate and the anode and including an opposed surface opposed to the surface to be plated, the opposed surface including a first opposed surface and a second opposed surface apart from the surface to be plated more than the first opposed surface; and a shielding member disposed in a depressed region of the ionically resistive element, the depressed region being formed by the second opposed surface. The shielding member is for shielding an electric field.

DESCRIPTION OF EMBODIMENTS

Figure 1:
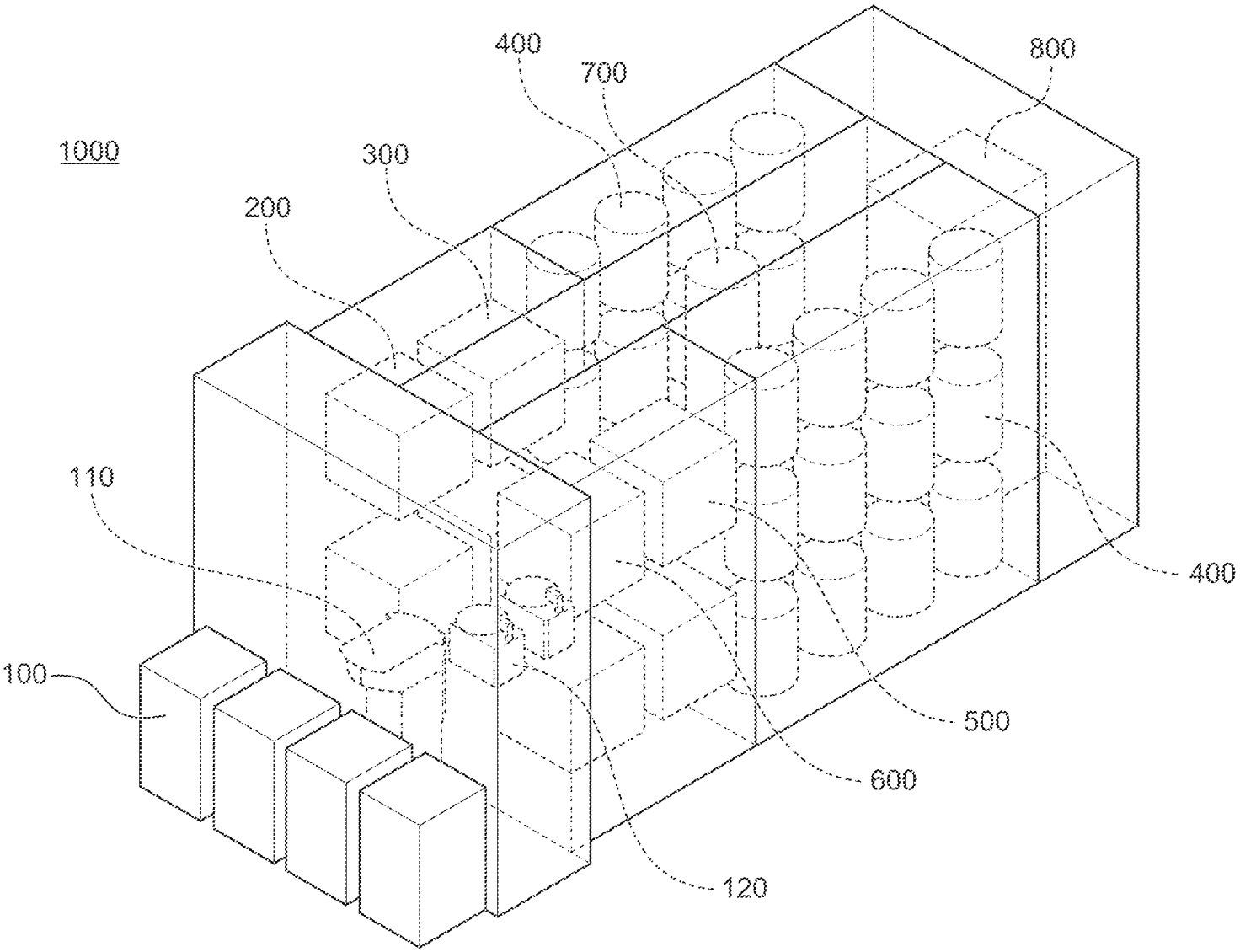
FIG. 1 is a perspective view illustrating an overall configuration of a plating apparatus of the embodiment.

The following describes embodiments of the present invention with reference to the drawings. In the drawings described below, identical reference numerals are attached to identical or equivalent components, and overlapping description will be omitted.

<Overall Configuration of Plating Apparatus>

Figure 2:
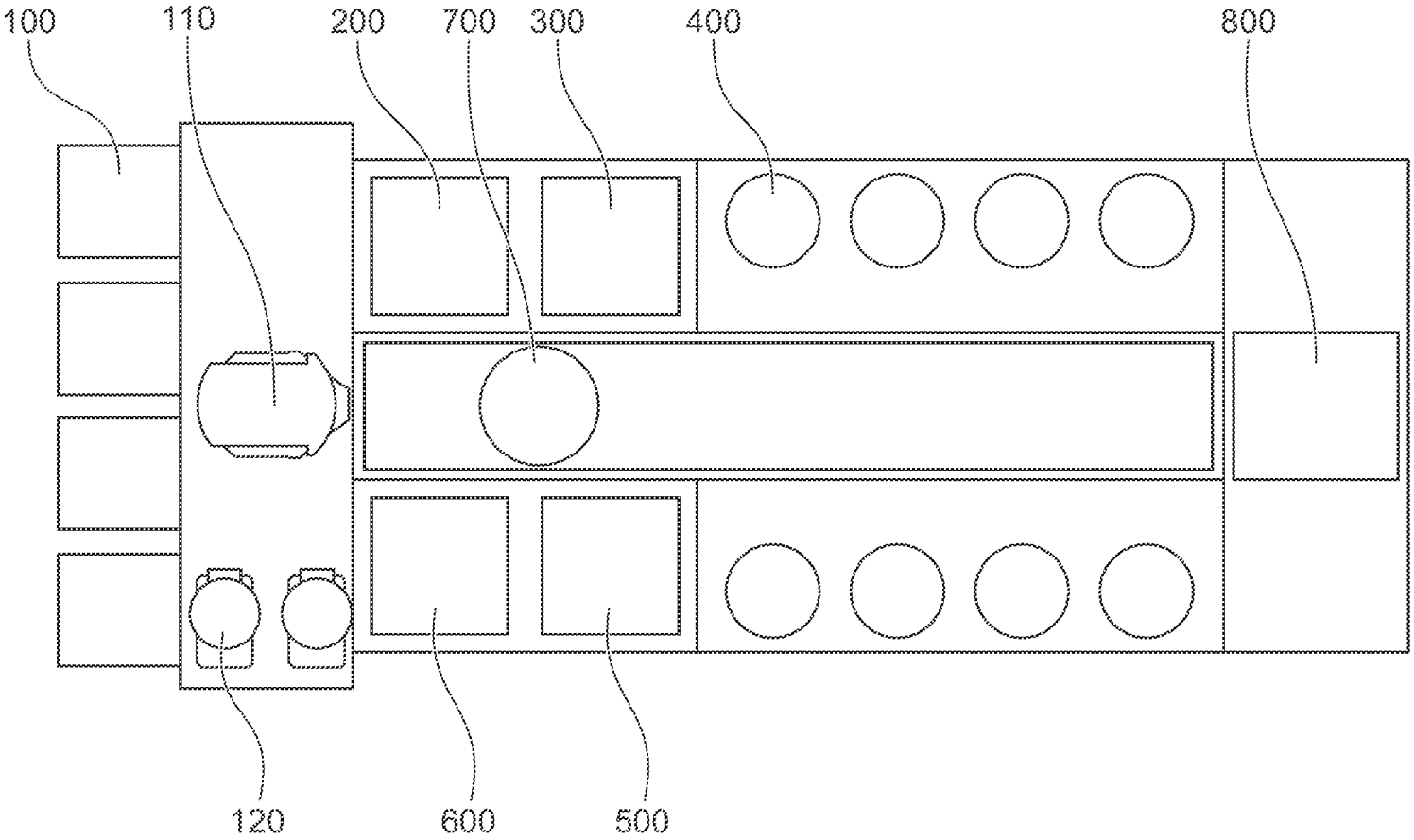
FIG. 2 is a plan view illustrating the overall configuration of the plating apparatus of the embodiment.

FIG. 1 is a perspective view illustrating the overall configuration of the plating apparatus of this embodiment. FIG. 2 is a plan view illustrating the overall configuration of the plating apparatus of this embodiment. As illustrated in FIGS. 1 and 2, a plating apparatus 1000 includes load ports 100, a transfer robot 110, aligners 120, pre-wet modules 200, pre-soak modules 300, plating modules 400, cleaning modules 500, spin rinse dryers 600, a transfer device 700, and a control module 800.

The load port 100 is a module for loading a substrate housed in a cassette, such as a FOUP, (not illustrated) to the plating apparatus 1000 and unloading the substrate from the plating apparatus 1000 to the cassette. While the four load ports 100 are arranged in the horizontal direction in this embodiment, the number of load ports 100 and arrangement of the load ports 100 are arbitrary. The transfer robot 110 is a robot for transferring the substrate that is configured to grip or release the substrate between the load port 100, the aligner 120, the pre-wet module 200, and the spin rinse dryers 600. The transfer robot 110 and the transfer device 700 can perform delivery and receipt of the substrate via a temporary placement table (not illustrated) to grip or release the substrate between the transfer robot 110 and the transfer device 700.

The aligner 120 is a module for adjusting a position of an orientation flat, a notch, and the like of the substrate in a predetermined direction. While the two aligners 120 are disposed to be arranged in the horizontal direction in this embodiment, the number of aligners 120 and arrangement of the aligners 120 are arbitrary. The pre-wet module 200 wets a surface to be plated of the substrate before a plating process with a process liquid, such as pure water or deaerated water, to replace air inside a pattern formed on the surface of the substrate with the process liquid. The pre-wet module 200 is configured to perform a pre-wet process to facilitate supplying the plating solution to the inside of the pattern by replacing the process liquid inside the pattern with a plating solution during plating. While the two pre-wet modules 200 are disposed to be arranged in the vertical direction in this embodiment, the number of pre-wet modules 200 and arrangement of the pre-wet modules 200 are arbitrary.

For example, the pre-soak module 300 is configured to remove an oxidized film having a large electrical resistance present on, a surface of a seed layer formed on the surface to be plated of the substrate before the plating process by etching with a process liquid, such as sulfuric acid and hydrochloric acid, and perform a pre-soak process that cleans or activates a surface of a plating base layer. While the two pre-soak modules 300 are disposed to be arranged in the vertical direction in this embodiment, the number of pre-soak modules 300 and arrangement of the pre-soak modules 300 are arbitrary. The plating module 400 performs the plating process on the substrate. There are two sets of the 12 plating modules 400 arranged by three in the vertical direction and by four in the horizontal direction, and the total 24 plating modules 400 are disposed in this embodiment, but the number of plating modules 400 and arrangement of the plating modules 400 are arbitrary.

The cleaning module 500 is configured to perform a cleaning process on the substrate to remove the plating solution or the like left on the substrate after the plating process. While the two cleaning modules 500 are disposed to be arranged in the vertical direction in this embodiment, the number of cleaning modules 500 and arrangement of the cleaning modules 500 are arbitrary. The spin rinse dryer 600 is a module for rotating the substrate after the cleaning process at high speed and drying the substrate. While the two spin rinse dryers are disposed to be arranged in the vertical direction in this embodiment, the number of spin rinse dryers and arrangement of the spin rinse dryers are arbitrary. The transfer device 700 is a device for transferring the substrate between the plurality of modules inside the plating apparatus 1000. The control module 800 is configured to control the plurality of modules in the plating apparatus 1000 and can be configured of, for example, a general computer including input/output interfaces with an operator or a dedicated computer.

An example of a sequence of the plating processes by the plating apparatus 1000 will be described. First, the substrate housed in the cassette is loaded on the load port 100. Subsequently, the transfer robot 110 grips the substrate from the cassette at the load port 100 and transfers the substrate to the aligners 120. The aligner 120 adjusts the position of the orientation flat, the notch, or the like of the substrate in the predetermined direction. The transfer robot 110 grips or releases the substrate whose direction is adjusted with the aligners 120 to the pre-wet module 200.

The pre-wet module 200 performs the pre-wet process on the substrate. The transfer device 700 transfers the substrate on which the pre-wet process has been performed to the pre-soak module 300. The pre-soak module 300 performs the pre-soak process on the substrate. The transfer device 700 transfers the substrate on which the pre-soak process has been performed to the plating module 400. The plating module 400 performs the plating process on the substrate.

The transfer device 700 transfers the substrate on which the plating process has been performed to the cleaning module 500. The cleaning module 500 performs the cleaning process on the substrate. The transfer device 700 transfers the substrate on which the cleaning process has been performed to the spin rinse dryer 600. The spin rinse dryer 600 performs the drying process on the substrate. The transfer robot 110 receives the substrate from the spin rinse dryer 600 and transfers the substrate, on which the drying process is performed, to the cassette at the load port 100. Finally, the cassette housing the substrate is unloaded from the load port 100.

<Configuration of Plating Module>

Next, the configuration of the plating module 400 will be described. Since the 24 plating modules 400 according to the embodiment have the same configuration, only one of the plating modules 400 will be described.

Figure 3:
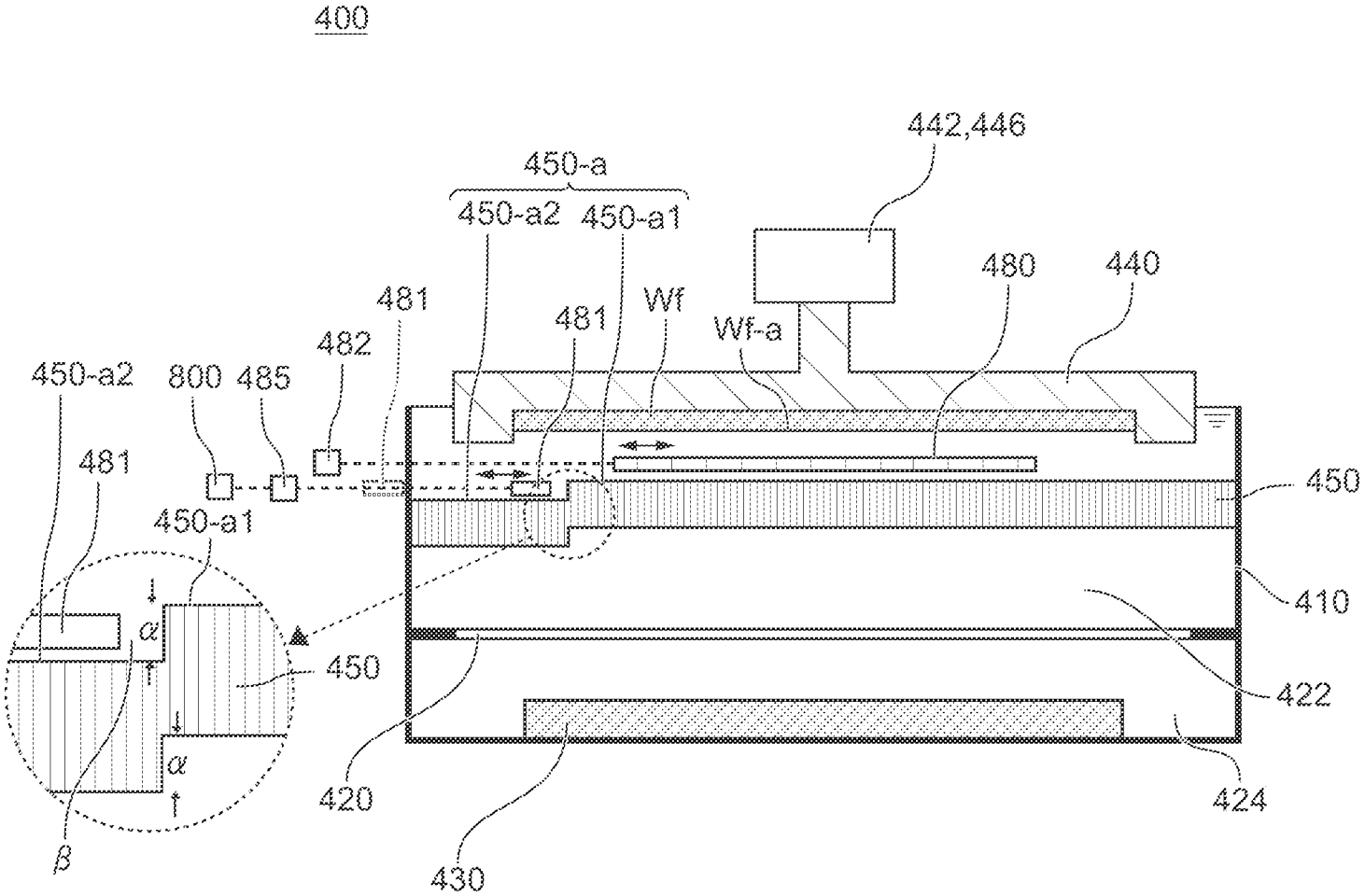
FIG. 3 is a vertical cross-sectional view schematically illustrating a configuration of the plating module of the embodiment.
Figure 4:
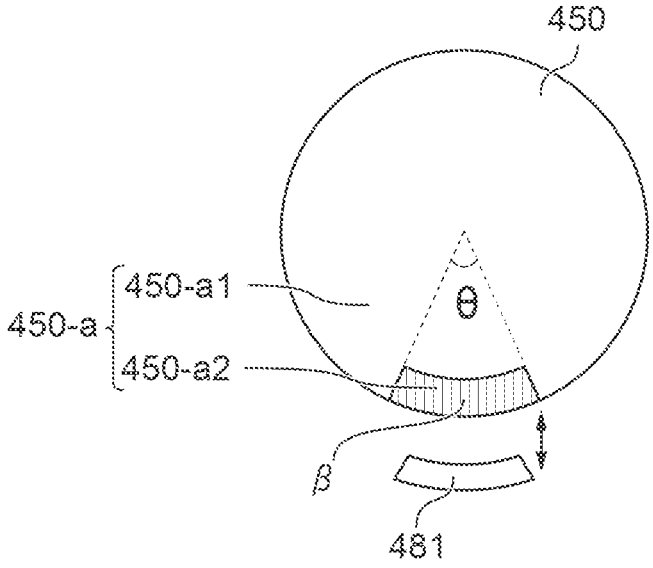
FIG. 4 is a plan view schematically illustrating an ionically resistive element of the embodiment.

FIG. 3 is a vertical cross-sectional view schematically illustrating the configuration of the plating module 400 of the embodiment. FIG. 4 is a plan view schematically illustrating an ionically resistive element of the embodiment. As illustrated in FIG. 3, the plating module 400 includes a plating tank 410 for housing a plating solution. The plating module 400 includes a membrane 420 dividing inside the plating tank 410 in the vertical direction. The inside of the plating tank 410 is divided into a cathode region 422 and an anode region 424 by the membrane 420. The cathode region 422 and the anode region 424 are each filled with the plating solution. An anode 430 is disposed on a bottom surface of the plating tank 410 in the anode region 424. The anode 430 is a circular plate-shaped member having a size approximately equal to that of a circular plate-shaped substrate Wf.

The plating module 400 includes a substrate holder 440 for holding the substrate Wf with a surface to be plated Wf-a facing downward. The substrate holder 440 includes a power feeding contact point (not illustrated) for feeding power from a power source to an outer edge portion of the substrate Wf. The plating module 400 includes an elevating mechanism 442 for moving up and down the substrate holder 440. The elevating mechanism 442 can be achieved by a known mechanism, such as a motor.

The plating module 400 includes a rotation mechanism 446 for rotating the substrate holder 440 such that the substrate Wf rotates about a virtual rotation axis extending perpendicularly in a center of the surface to be plated Wf-a. The rotation mechanism 446 can be achieved by a known mechanism, such as a motor. The plating module 400 is configured to perform a plating process on the surface to be plated Wf-a of the substrate Wf by immersing the substrate Wf in the plating solution in the cathode region 422 using the elevating mechanism 442 and applying a voltage between the anode 430 and the substrate Wf while rotating the substrate Wf using the rotation mechanism 446.

The plating module 400 includes an ionically resistive element 450 disposed between the substrate Wf and the anode 430. The ionically resistive element 450 is disposed to be opposed to the membrane 420 in the cathode region 422.

The ionically resistive element 450 is a e member for attempting to uniformize the plating process on the surface to be plated Wf-a of the substrate Wf. In one embodiment, the ionically resistive element 450 is configured of a plate-shaped member (punching plate) provided with a plurality of through-holes penetrating between the anode 430 side and the substrate Wf side. However, the ionically resistive element 450 has any shape. The ionically resistive element 450 is not limited to the punching plate, and for example, may be configured of a porous body in which many pores are provided to a ceramic material.

The plating module 400 includes a paddle 480 disposed between the substrate Wf held by the substrate holder 440 and the ionically resistive element 450, and a paddle stirring mechanism 482 for stirring the plating solution with the paddle 480. While the paddle 480 can be configured of, for example, a plate member including a plurality of rod-shaped members arranged in a grid pattern, it is not limited to this, and can be configured of a plate member provided with many holes in a honeycomb shape. The paddle stirring mechanism 482 can be achieved by a known mechanism, such as a motor. The paddle stirring mechanism 482 is configured to stir the plating solution in the proximity of the surface to be plated of the substrate Wf by reciprocating the paddle 480 along the surface to be plated Wf-a of the substrate Wf.

The above-described ionically resistive element 450 acts as an ionically resistive element between the anode 430 and the substrate Wf By disposing the ionically resistive element 450, since a resistance value between the anode 430 and the substrate Wf increases, an electric field becomes less likely to expand, and consequently, the uniformity of film-thickness distribution of a plating film formed on the surface to be plated Wf-a of the substrate Wf can be improved.

The ionically resistive element 450 affects the plating film-thickness distribution especially at the outer edge portion of the surface to be plated Wf-a of the substrate Wf That is, when a distance between the substrate Wf and the ionically resistive element 450 increases, a space in which an electric field between the substrate Wf and the ionically resistive element 450 is expandable increases. Here, since the power feeding contact point of the substrate holder 440 is in contact with the outer edge portion of the substrate Wf, the electric field relatively concentrates to the outer edge portion of the substrate Wf, and the plating film-thickness of the outer edge portion increases. Accordingly, the ionically resistive element 450 is preferably disposed in the proximity of the surface to be plated Wf-a of the substrate Wf.

However, the plating module 400 of this embodiment includes the shielding member 481 disposed between the substrate Wf and the ionically resistive element 450. The shielding member 481 is a member for shielding the electric field formed between the anode 430 and the substrate Wf. The shielding member 481 may be, for example, a shielding plate formed in a plate shape. The plating module 400 includes a shielding mechanism 485 for moving the shielding member 481. The shielding mechanism 485 is configured to operate in response to a command signal based on information regarding a rotation angle of the substrate holder 440 input from the control module 800.

Specifically, the shielding mechanism 485 is configured to move the shielding member 481 to a shielding position between the ionically resistive element 450 and the substrate Wf as indicated by a solid line in FIG. 3 when a rotation angle of a specific portion of the substrate Wf in which a deposition rate of plating is to be suppressed is within a predetermined range. Meanwhile, the shielding mechanism 485 is configured to move the shielding member 481 to a retracted position apart from between the ionically resistive element 450 and the substrate Wf as indicated by a dashed line in FIG. 3 when the rotation angle of the specific portion is out of the predetermined range.

In the prior art, when the shielding member 481 is disposed between the ionically resistive element 450 and the substrate Wf, the ionically resistive element 450 needs to be disposed to be apart from the surface to be plated Wf-a of the substrate Wf to avoid the interference between the ionically resistive element 450 and the shielding member 481, and consequently, it becomes difficult to improve the uniformity of the distribution of plating film-thickness.

In contrast, as illustrated in FIG. 3 and FIG. 4, the ionically resistive element 450 of this embodiment is configured such that a part of an outer edge portion of the ionically resistive element 450 is displaced to the anode 430 side. Specifically, the ionically resistive element 450 includes an opposed surface 450-*a* opposed to the surface to be plated Wf-a of the substrate Wf. The opposed surface 450-*a* includes a first opposed surface 450-*a*1 and a second opposed surface 450-*a*2 apart from the surface to be plated Wf-a more than the first opposed surface 450-*a*1. In this embodiment, corresponding to a shape of the shielding member 481 formed in an arc shape, the second opposed surface 450-*a*2 is formed in an arc shape at an outer edge portion of the opposed surface 450-*a* in a range of a central angle θ=400 (a part of the outer edge portion of the opposed surface 450-*a*). The range and the shape in which the second opposed surface 450-*a*2 is formed can be appropriately set corresponding to the shape of the shielding member 481.

The ionically resistive element 450 is formed such that a resistivity in the first opposed surface 450-*a*1 and a resistivity in the second opposed surface 450-*a*2 are made uniform. Specifically, the second opposed surface 450-*a*2 is formed to be depressed by a mm with respect to the first opposed surface 450-*a*1. The second opposed surface 450-*a*2 of the ionically resistive element 450 has a back surface formed to be projected by a mm with respect to a back surface of the first opposed surface 450-*a*1. Therefore, the ionically resistive element 450 is formed such that the thickness of the ionically resistive element 450 in the first opposed surface 450-*a*1 and the thickness of the ionically resistive element 450 in the second opposed surface 450-*a*2 are made uniform.

In this embodiment, the shielding member 481 is disposed in a depressed region β formed by the second opposed surface 450-*a*2 in the opposed surface 450-*a* of the ionically resistive element 450. That is, the shielding mechanism 485 is configured to move the shielding member 481 into between the second opposed surface 450-*a*2 of the ionically resistive element 450 and the substrate Wf (depressed region β) as indicated by the solid line in FIG. 3 when the rotation angle of the specific portion of the substrate Wf is within the predetermined range. The shielding mechanism 485 is configured move the shielding member 481 to the retracted position apart from between the second opposed surface 450-*a*2 of the ionically resistive element 450 and the substrate Wf as indicated by the dashed line in FIG. 3 when the rotation angle of the specific portion is out of the predetermined range.

According to the plating module 400 of this embodiment, in the plating apparatus including the shielding member 481, the ionically resistive element 450 is disposed to be close to the surface to be plated Wf-a of the substrate Wf, thereby allowing the improvement of the uniformity of the distribution of plating film-thickness. The following describes this respect.

Figure 5:
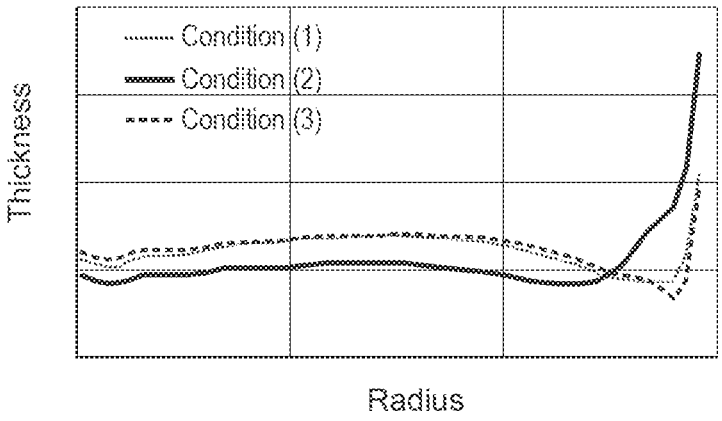
FIG. 5 is a drawing illustrating simulation results of a distribution of plating film-thickness under respective conditions.

FIG. 5 is a drawing illustrating simulation results of a distribution of plating film-thickness under respective conditions. FIG. 5 illustrates the simulation results of the distribution of plating film-thickness in a state where the shielding member 481 is not disposed. In the graph of FIG. 5, the horizontal axis indicates a radius from the center of the surface to be plated Wf-a to the outer edge portion, and the vertical axis indicates the plating film-thickness. In FIG. 5, a condition (1) indicates a distribution of the plating film-thickness when the ionically resistive element 450 has a simple circular plate shape. A condition (2) indicates a distribution of the plating film-thickness when a portion corresponding to the second opposed surface 450-*a*2 of the ionically resistive element 450 is thinned to decrease the plate thickness. A condition (3) indicates a distribution of the plating film-thickness when the portion corresponding to the second opposed surface 450-*a*2 of the ionically resistive element 450 is displaced to the anode 430 side as illustrated in FIG. 3. In the condition (1) to the condition (3), opening rates of the plurality of through-holes are uniform in the whole surface of the ionically resistive element 450.

As illustrated in FIG. 5, a result was obtained that the film thickness of the outer edge portion of the substrate Wf was extremely increased under the condition (2). It is considered that this is because the resistance was reduced by thinning the plate thickness of the outer edge portion of the ionically resistive element 450. In contrast, under the condition (3), the film-thickness distribution similar to that of the condition (1) was obtained. That is, a result was obtained that the formation of the ionically resistive element 450 as illustrated in FIG. 3 did not affect the performance as the ionically resistive element 450.

Figure 6:
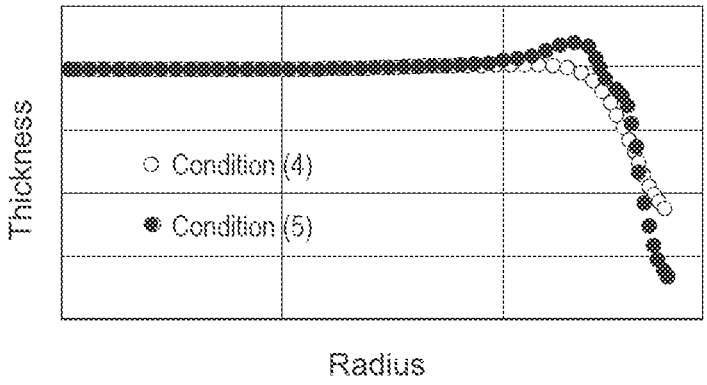
FIG. 6 is a drawing illustrating simulation results of the distribution of plating film-thickness under respective conditions.

FIG. 6 is a drawing illustrating simulation results of the distribution of plating film-thickness under respective conditions. In the graph of FIG. 6, the horizontal axis indicates the radius from the center of the surface to be plated Wf-a to the outer edge portion, and the vertical axis indicates the plating film-thickness. In FIG. 6, a condition (4) indicates a distribution of the plating film-thickness when a portion corresponding to the second opposed surface 450-*a*2 of the ionically resistive element 450 is displaced to the anode 430 side, and the shielding member 481 is disposed in the depressed region/of the second opposed surface 450-*a*2 as illustrated in FIG. 3. A condition (5) indicates a distribution of the plating film-thickness when the shielding member 481 is disposed between the ionically resistive element 450 having a simple circular plate shape and the substrate Wf A result was obtained that the plating film-thickness of the outer edge portion of the surface to be plated Wf-a was extremely thinned and the plating film-thickness inside the outer edge portion was extremely thickened under the condition (5). This result will be described by referring to FIG. 7.

Figure 7:
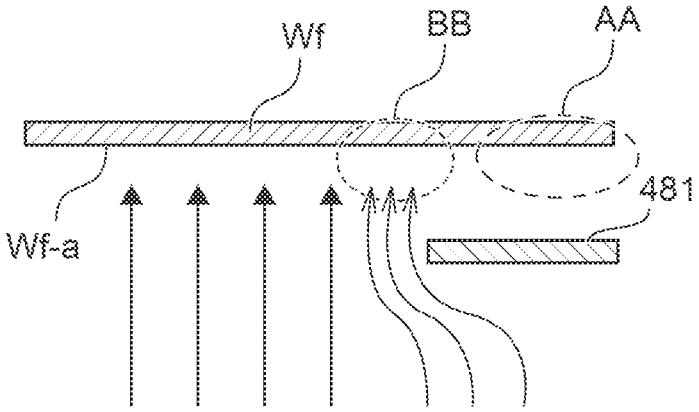
FIG. 7 is a drawing schematically illustrating a diversion of an electric field by a shielding member.

FIG. 7 is a drawing schematically illustrating a diversion of an electric field by a shielding member. As illustrated in FIG. 7, when the shielding member 481 is brought excessively close to the surface to be plated Wf-a of the substrate Wf, an electric field to an outer edge portion AA of the surface to be plated Wf-a is excessively suppressed, while an electric field shielded by the shielding member 481 is diverted concentratively to an inside BB of the outer edge portion. Consequently, it is considered that the plating film-thickness of the outer edge portion of the surface to be plated Wf-a is extremely thinned and the plating film-thickness inside the outer edge portion is extremely thickened as indicated by the result of the condition (5).

In contrast, according to the embodiment (condition (4)), the shielding member 481 is disposed to be appropriately spaced from the surface to be plated Wf-a of the substrate Wf and the ionically resistive element 450 is disposed in the depressed region β, thereby allowing disposing the ionically resistive element 450 to be close to the surface to be plated Wf-a without the interference with the shielding member 481. Consequently, the uniformity of the distribution of plating film-thickness can be improved as indicated by the result of the condition (4).

While the example in which the thickness of the ionically resistive element 450 in the first opposed surface 450-*a*1 and the thickness of the ionically resistive element 450 in the second opposed surface 450-*a*2 are uniformly formed is described in the above-described embodiment, it is not limited to this. For example, in the ionically resistive element 450, while the second opposed surface 450-*a*2 is formed and the depressed region β is provided thereto similarly to the embodiment of FIG. 3, the back surface of the second opposed surface 450-*a*2 may be a planar surface without projecting with respect to the back surface of the first opposed surface 450-*a*1. In this case, the ionically resistive element 450 can be formed such that the opening rate of the first opposed surface 450-*a*1 by the plurality of through-holes is larger than the opening rate of the second opposed surface 450-*a*2 by the plurality of through-holes. That is, since the thickness of the first opposed surface 450-*a*1 of the ionically resistive element 450 is larger than the thickness of the second opposed surface 450-*a*2, by increasing the opening rate by its amount, the resistivity in the first opposed surface 450-*a*1 and the resistivity in the second opposed surface 450-*a*2 can be made uniform.

Figure 8:
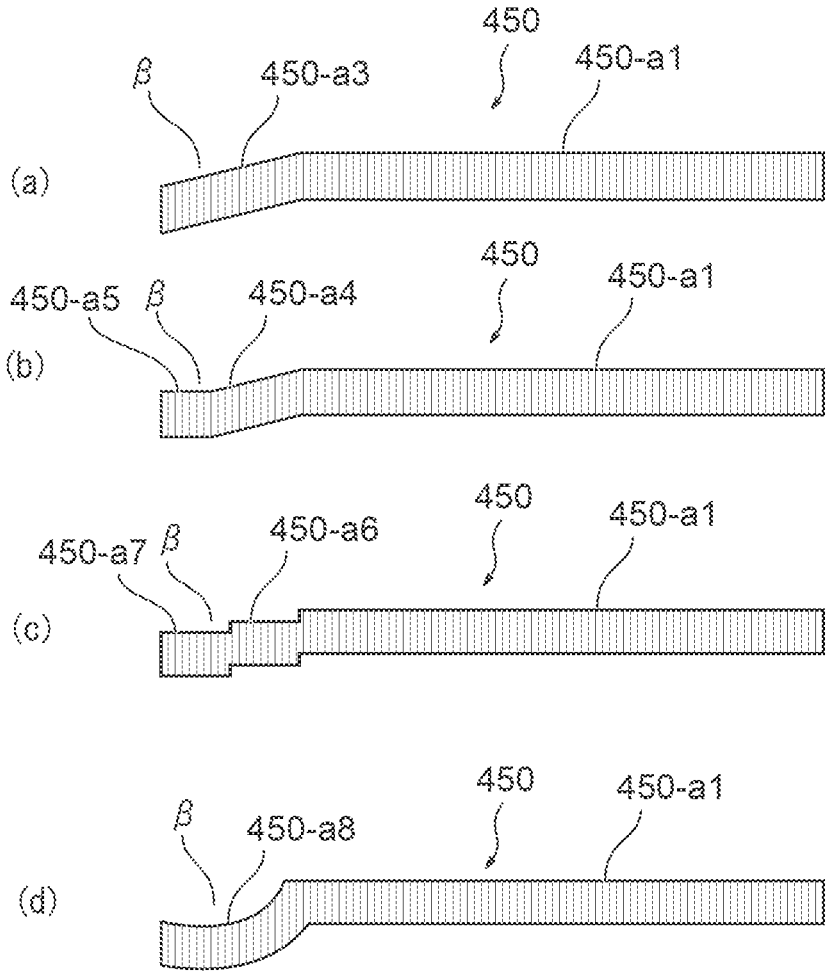
FIG. 8 includes drawings schematically illustrating modifications of the ionically resistive element.

The ionically resistive element 450 can have various configurations in addition to the configuration illustrated in FIG. 3. FIG. 8 includes drawings schematically illustrating modifications of the ionically resistive element. As illustrated in FIG. 8(*a*), the outer edge portion of the ionically resistive element 450 may be inclined toward the anode side (lower side). Thus, an inclined surface 450-*a*3 is formed in the opposed surface of the ionically resistive element 450. The inclined surface 450-*a*3 corresponds to a second opposed surface in the above-described embodiment. By forming the inclined surface 450-*a*3, the depressed region β in which the shielding member 481 is disposed is formed to the ionically resistive element 450.

As illustrated in FIG. 8(*b*), the outer edge portion of the ionically resistive element 450 may be inclined toward the anode side (lower side) and further extend outward. Thus, an inclined surface 450-*a*4 and a stepped surface 450-*a*5 extending outward from a lower end of the inclined surface 450-*a*4 are formed in the opposed surface of the ionically resistive element 450. The inclined surface 450-*a*4 and the stepped surface 450-*a*5 correspond to the second opposed surface of the above-described embodiment. By forming the inclined surface 450-*a*4 and the stepped surface 450-*a*5, the depressed region β in which the shielding member 481 is disposed is formed to the ionically resistive element 450.

As illustrated in FIG. 8(*c*), the outer edge portion of the ionically resistive element 450 may be depressed toward the anode side (lower side) in two stages. Thus, a stepped surface 450-*a*6 more apart (depressed) from the surface to be plated Wf-a than the first opposed surface 450-*a*1 and a stepped surface 450-*a*7 more apart (depressed) from the surface to be plated Wf-a than the stepped surface 450-*a*6 are formed in the opposed surface of the ionically resistive element 450. The stepped surface 450-*a*6 and the stepped surface 450-*a*7 correspond to the second opposed surface of the above-described embodiment. By forming the stepped surface 450-*a*6 and the stepped surface 450-*a*7, the depressed region β in which the shielding member 481 is disposed is formed to the ionically resistive element 450.

As illustrated in FIG. 8(*d*), the outer edge portion of the ionically resistive element 450 may be curved in an arc shape toward the anode side (lower side). Thus, a circular arc surface 450-*a*8 is formed in the opposed surface of the ionically resistive element 450. The circular arc surface 450-*a*8 corresponds to the second opposed surface in the above-described embodiment. By forming the circular arc surface 450-*a*8, the depressed region β in which the shielding member 481 is disposed is formed to the ionically resistive element 450.

While some embodiments of the present invention have been described above, the above-described embodiments of the invention are for ease of understanding the present invention, and are not for limiting the present invention. It is obvious that the present invention can be changed or improved without departing from its gist, and that the present invention encompasses its equivalents. Within a range that can solve at least a part of the above-described problems or a range that provides at least a part of the effects, any combination or omission of each component described in the claim and the description are allowed.

This application discloses a plating apparatus as one embodiment. The plating apparatus includes: a plating tank configured to house a plating solution; a substrate holder configured to hold a substrate with a surface to be plated facing downward; an anode disposed in the plating tank; an ionically resistive element disposed between the substrate and the anode and including an opposed surface opposed to the surface to be plated, the opposed surface including a first opposed surface and a second opposed surface apart from the surface to be plated more than the first opposed surface; and a shielding member disposed in a depressed region of the ionically resistive element, the depressed region being formed by the second opposed surface. The shielding member is for shielding an electric field.

Furthermore, this application discloses, as one embodiment, the plating apparatus in which the ionically resistive element is formed such that a resistivity in the first opposed surface and a resistivity in the second opposed surface are made uniform.

Furthermore, this application discloses, as one embodiment, the plating apparatus in which the ionically resistive element is a plate-shaped member provided with a plurality of through-holes penetrating between the anode side and the substrate side, and the ionically resistive element is formed such that a thickness of the ionically resistive element in the first opposed surface and a thickness of the ionically resistive element in the second opposed surface are made uniform.

Furthermore, this application discloses, as one embodiment, the plating apparatus in which the ionically resistive element is a plate-shaped member provided with a plurality of through-holes penetrating between the anode side and the substrate side, and the ionically resistive element is formed such that a thickness of the ionically resistive element in the first opposed surface is larger than a thickness of the ionically resistive element in the second opposed surface, and an opening rate of the first opposed surface by the plurality of through-holes is larger than an opening rate of the second opposed surface by the plurality of through-holes.

Furthermore, this application discloses, as one embodiment, the plating apparatus in which the second opposed surface is formed in a part of an outer edge portion of the opposed surface.

Furthermore, this application discloses, as one embodiment, the plating apparatus that further includes a shielding mechanism configured to reciprocate the shielding member in a direction along the surface to be plated of the substrate between a shielding position and a retracted position corresponding to a rotation angle of the substrate holder, the shielding position is between the second opposed surface of the ionically resistive element and the substrate, and the retracted position is apart from between the second opposed surface of the ionically resistive element and the substrate.

Furthermore, this application discloses, as one embodiment, the plating apparatus that further includes: a paddle disposed between the ionically resistive element and the substrate; and a paddle stirring mechanism configured to reciprocate the paddle in the direction along the surface to be plated of the substrate.

REFERENCE SIGNS LIST

400 . . . plating module
410 . . . plating tank
430 . . . anode
440 . . . substrate holder
442 . . . elevating mechanism
446 . . . rotation mechanism
450 . . . ionically resistive element
450-*a* . . . opposed surface
450-*a*1 . . . first opposed surface
450-*a*2 . . . second opposed surface
480 . . . paddle
481 . . . shielding member
482 . . . paddle stirring mechanism
485 . . . shielding mechanism
1000 . . . plating apparatus
Wf . . . substrate
Wf-a . . . surface to be plated
β . . . depressed region

The invention claimed is:

1. A plating apparatus comprising:

a plating tank configured to house a plating solution;

a substrate holder configured to hold a substrate with a surface to be plated facing downward;

an anode disposed in the plating tank;

an ionically resistive element disposed between the substrate and the anode and including an opposed surface opposed to the surface to be plated, the opposed surface including a first opposed surface and a second opposed surface apart from the surface to be plated more than the first opposed surface; and a shielding member disposed in a depressed region of the ionically resistive element, the depressed region being formed by the second opposed surface, the shielding member being for shielding an electric field, wherein the ionically resistive element is formed such that a resistivity in the first opposed surface and a resistivity in the second opposed surface are made uniform wherein the ionically resistive element is a plate-shaped member provided with a plurality of through-holes penetrating between the anode side and the substrate side, and the ionically resistive element is formed such that a thickness of the ionically resistive element in the first opposed surface is larger than a thickness of the ionically resistive element in the second opposed surface, and an opening rate of the first opposed surface by the plurality of through-holes is larger than an opening rate of the second opposed surface by the plurality of through-holes.

2. The plating apparatus according to claim 1, wherein the second opposed surface is formed in a part of an outer edge portion of the opposed surface.

3. The plating apparatus according to claim 1, further comprising:

a paddle disposed between the ionically resistive element and the substrate; and a paddle stirring mechanism configured to reciprocate the paddle in the direction along the surface to be plated of the substrate.

4. A plating apparatus comprising:

a plating tank configured to house a plating solution;

a substrate holder configured to hold a substrate with a surface to be plated facing downward;

an anode disposed in the plating tank;

an ionically resistive element disposed between the substrate and the anode and including an opposed surface opposed to the surface to be plated, the opposed surface including a first opposed surface and a second opposed surface apart from the surface to be plated more than the first opposed surface;

a shielding member disposed in a depressed region of the ionically resistive element, the depressed region being formed by the second opposed surface, the shielding member being for shielding an electric field; and a shielding mechanism configured to reciprocate the shielding member in a direction along the surface to be plated of the substrate between a shielding position and a retracted position corresponding to a rotation angle of the substrate holder, the shielding position being between the second opposed surface of the ionically resistive element and the substrate, the retracted position being apart from between the second opposed surface of the ionically resistive element and the substrate.

5. The plating apparatus according to claim 4, wherein the ionically resistive element is formed such that a resistivity in the first opposed surface and a resistivity in the second opposed surface are made uniform.

6. The plating apparatus according to claim 4, wherein the ionically resistive element is a plate-shaped member provided with a plurality of through-holes penetrating between the anode side and the substrate side, and the ionically resistive element is formed such that a thickness of the ionically resistive element in the first opposed surface and a thickness of the ionically resistive element in the second opposed surface are made uniform.

7. The plating apparatus according to claim 4, wherein the ionically resistive element is a plate-shaped member provided with a plurality of through-holes penetrating between the anode side and the substrate side, and the ionically resistive element is formed such that a thickness of the ionically resistive element in the first opposed surface is larger than a thickness of the ionically resistive element in the second opposed surface, and an opening rate of the first opposed surface by the plurality of through-holes is larger than an opening rate of the second opposed surface by the plurality of through-holes.

8. The plating apparatus according to claim 4, wherein the second opposed surface is formed in a part of an outer edge portion of the opposed surface.

9. The plating apparatus according to claim 4, further comprising:

a paddle disposed between the ionically resistive element and the substrate; and a paddle stirring mechanism configured to reciprocate the paddle in the direction along the surface to be plated of the substrate.

* * * * *